US007059394B2

(12) United States Patent
Cho et al.

(10) Patent No.: US 7,059,394 B2
(45) Date of Patent: Jun. 13, 2006

(54) HEAT EXCHANGER

(75) Inventors: Nam Soo Cho, Seoul (KR); Jang Seok Lee, Incheon (KR); Sung Jhee, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/746,765

(22) Filed: Dec. 23, 2003

(65) Prior Publication Data

US 2004/0194935 A1 Oct. 7, 2004

(30) Foreign Application Priority Data

Mar. 19, 2003 (KR) ..... 10-2003-0017160

(51) Int. Cl.
*F28D 1/047* (2006.01)

(52) U.S. Cl. ..... 165/150; 165/152

(58) Field of Classification Search ..... 165/148–184
See application file for complete search history.

(56) References Cited

U.S. PATENT DOCUMENTS

| | | | | | |
|---|---|---|---|---|---|
| 1,284,578 | A | * | 11/1918 | Branzell | 165/165 |
| 3,780,799 | A | * | 12/1973 | Pastemak | 165/150 |
| 4,365,667 | A | * | 12/1982 | Hatada et al. | 165/152 |
| 4,645,001 | A | * | 2/1987 | Hillerstrom | 165/159 |
| 4,755,331 | A | * | 7/1988 | Merrill et al. | 165/172 |
| 4,901,791 | A | * | 2/1990 | Kadle | 165/150 |
| 5,036,909 | A | * | 8/1991 | Whitehead et al. | 165/133 |
| 5,052,476 | A | * | 10/1991 | Sukumoda et al. | 165/133 |
| 5,123,482 | A | * | 6/1992 | Abraham | 165/173 |
| 5,407,004 | A | * | 4/1995 | DeRisi et al. | 165/153 |
| 5,411,079 | A | * | 5/1995 | Sasaki et al. | 165/151 |
| 5,425,414 | A | * | 6/1995 | Bradley et al. | 165/150 |
| 5,584,340 | A | * | 12/1996 | Derosier | 165/82 |
| 5,799,725 | A | * | 9/1998 | Bradley et al. | 165/150 |
| 5,894,649 | A | * | 4/1999 | Lambert et al. | 29/890.052 |
| 6,044,900 | A | * | 4/2000 | Kawahara | 165/110 |
| 2004/0256093 | A1 | * | 12/2004 | Romero Beltran | 165/150 |

FOREIGN PATENT DOCUMENTS

| | | |
|---|---|---|
| CN | 1299954 | 6/2001 |
| JP | 60-205192 | 10/1985 |
| JP | 07-077397 | 3/1995 |
| JP | 11-094481 | 4/1999 |
| JP | 2000-176539 | 6/2000 |
| KR | 102000-60550 A | 10/2000 |
| KR | 102001-59566 A | 7/2001 |

* cited by examiner

*Primary Examiner*—Teresa J. Walberg
(74) *Attorney, Agent, or Firm*—Lee, Hong, Degerman, Kang & Schmadeka

(57) ABSTRACT

A heat exchanger comprising a plurality of refrigerant pipes bent many times for passing a refrigerant for heat exchange; and cooling fins arranged at an outer circumference surface of the refrigerant pipes for expanding a contact area of air which passes through the refrigerant pipes, wherein a direction that the refrigerant pipes are bent is a major axis and a perpendicular direction to the major axis is a minor axis. In the heat exchanger, a bending portion of the refrigerant pipe is prevented from being distorted thus to have a smooth refrigerant flow and enhance a heat exchange performance.

8 Claims, 5 Drawing Sheets

HEAT EXCHANGER

BACKGROUND OF THE INVENTION

1. Field of the Invention

The present invention relates to a heat exchanger, and more particularly, to a heat exchanger capable of enhancing a heat exchange function by preventing a bending portion of a refrigerant pipe from being distorted at the time of bending the refrigerant pipe.

2. Description of the Conventional Art

Generally, a heat exchanger is a device for heat exchanging by contacting two different fluids directly or indirectly, and it is mainly used in a heater, a cooler, an evaporator, a condenser, and etc.

FIG. 1 is a perspective view of a fin and tube type heat exchanger mainly used at a refrigerating apparatus in accordance with the conventional art.

The conventional heat exchanger comprises a refrigerant pipe 102 for passing a refrigerant and performing a heat exchange, a plurality of cooling fins 104 mounted at the refrigerant pipe 102 with a certain interval for expanding a contact area of air which passes through the refrigerant pipe 102 in order to enhance a heat transmitting performance, and a supporting holder 106 mounted at both sides of the refrigerant pipe 102 for supporting the refrigerant pipe 102.

As shown in FIG. 2, the refrigerant pipe 102 is composed of a tube portion 110 of which a cross-section is a circular shape, and a bending portion 112 that the tube portion 110 is bent as a U shape.

As shown in FIG. 3, the tube portion 110 is formed as a circular pipe of which a cross section is a circular shape. Also, as shown in FIG. 4, the bending portion 112 is distorted along a direction that the refrigerant pipe is bent since the tube portion 110 is a circular pipe, so that a sectional area of the bending portion 112 drastically becomes narrow.

Like this, in the conventional heat exchanger, the bending portion 112 of the refrigerant pipe is distorted at the time of bending the refrigerant pipe 102, thereby preventing a flow of a refrigerant which passes through the bending portion 112 and thus degrading heat transmitting efficiency.

Especially, the faster a production speed is, the more the distortion of the bending portion 112 of the refrigerant pipe 102 is, thereby lowering a productivity.

In case that the conventional heat exchanger is applied to a refrigerating apparatus, a flow of a refrigerant which passes through a refrigerant pipe is not smooth thus to lower heat transmitting performance and degrade a cooling performance of the refrigerating apparatus.

SUMMARY OF THE INVENTION

Therefore, an object of the present invention is to provide a heat exchanger having a smooth refrigerant flow and capable of enhancing a heat exchange performance by preventing a bending portion of a refrigerant pipe from being distorted at the time of fabricating the heat exchanger.

Another object of the present invention is to provide a heat exchanger capable of increasing a production speed and thus enhancing a productivity by preventing a bending portion of a refrigerant pipe from being distorted even in a fast production speed at the time of fabricating the heat exchanger.

To achieve these and other advantages and in accordance with the purpose of the present invention, as embodied and broadly described herein, there is provided a heat exchanger comprising: a plurality of refrigerant pipes bent many times for passing a refrigerant for heat exchange; and cooling fins arranged at an outer circumference surface of the refrigerant pipes for expanding a contact area of air which passes through the refrigerant pipes, wherein the refrigerant pipes have a sectional surface of an oval shape.

A major axis of the refrigerant pipe is a diameter in a direction that the refrigerant pipe is stacked, and a minor axis of the refrigerant pipe is a diameter in a perpendicular direction to the direction that the refrigerant pipe is stacked.

A length ratio between the major axis and the minor axis of the refrigerant pipe is 1.4~2.1:1.

A plurality of grooves are formed at an inner circumferential surface of the refrigerant pipe towards an axial direction.

A heat exchanger according to the present invention comprises: a plurality of refrigerant pipes bent many times for passing a refrigerant for heat exchange; and cooling fins integrally arranged between the refrigerant pipes for expanding a contact area of air which passes through the refrigerant pipes, wherein the refrigerant pipe is composed of a straight-line portion in which the cooling fins are formed and a bending portion in which the refrigerant fins are removed, and a cross-section of the straight-line portion is an oval shape.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Even through plural embodiments for a heat exchanger according to the present invention can exist, the most preferable embodiment will be explained hereinafter.

Figure 1:
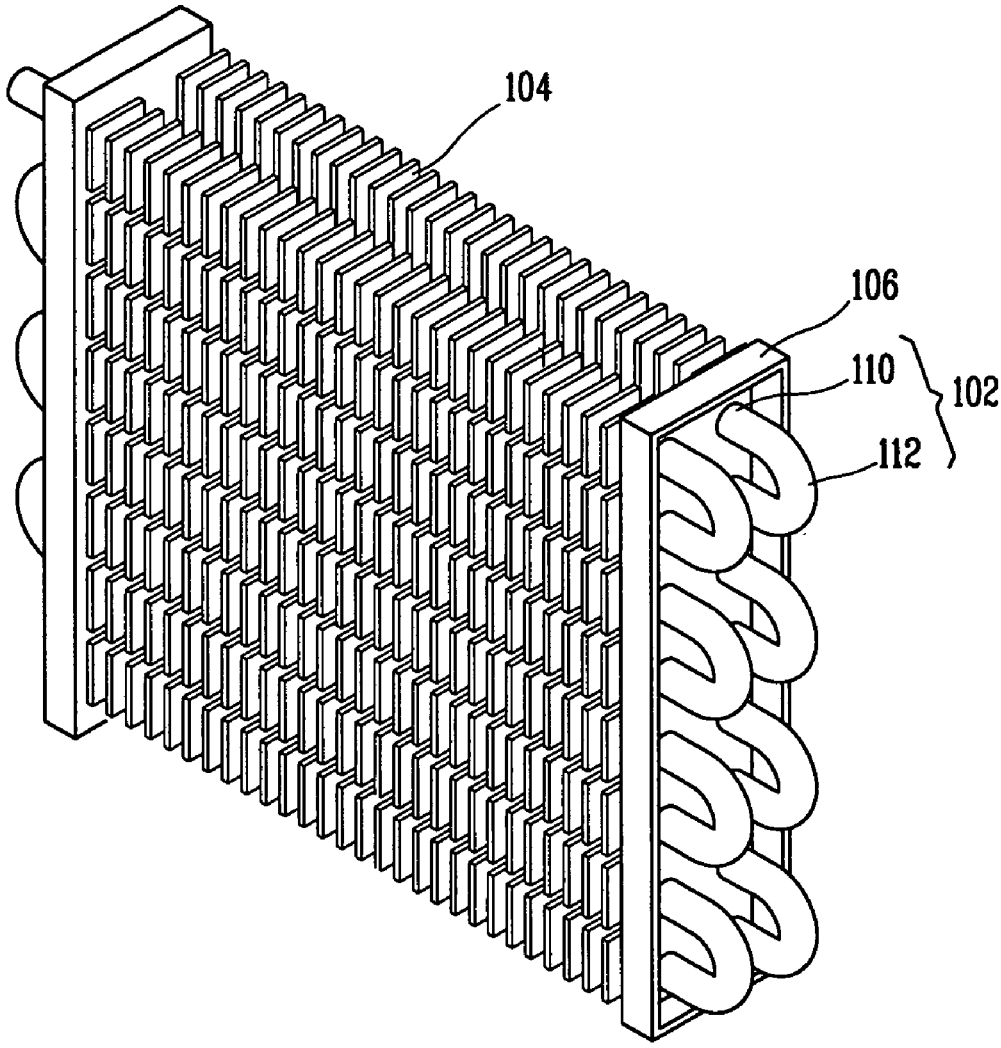
FIG. 1 CONVENTIONAL ART
FIG. 1 is a perspective view of a heat exchanger in accordance with the conventional art.
Figure 2:
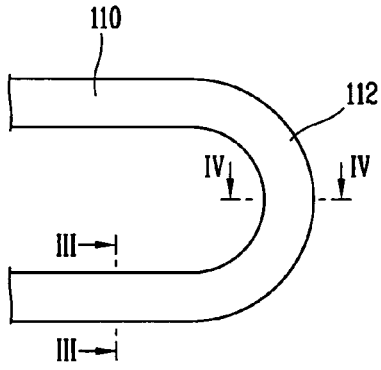
FIG. 2 CONVENTIONAL ART
FIG. 2 is a partial lateral view of a refrigerant pipe of a heat exchanger in accordance with the conventional art.
Figure 3:
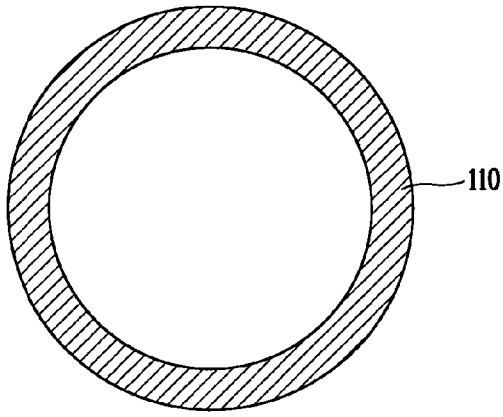
FIG. 3 CONVENTIONAL ART
FIG. 3 is a sectional view taken along line 111—111 of FIG. 2.
Figure 4:
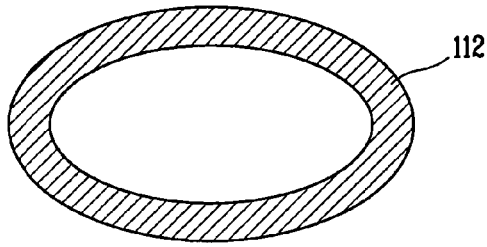
FIG. 4 CONVENTIONAL ART
FIG. 4 is a sectional view taken along line IV—IV of FIG. 3.
Figure 5:
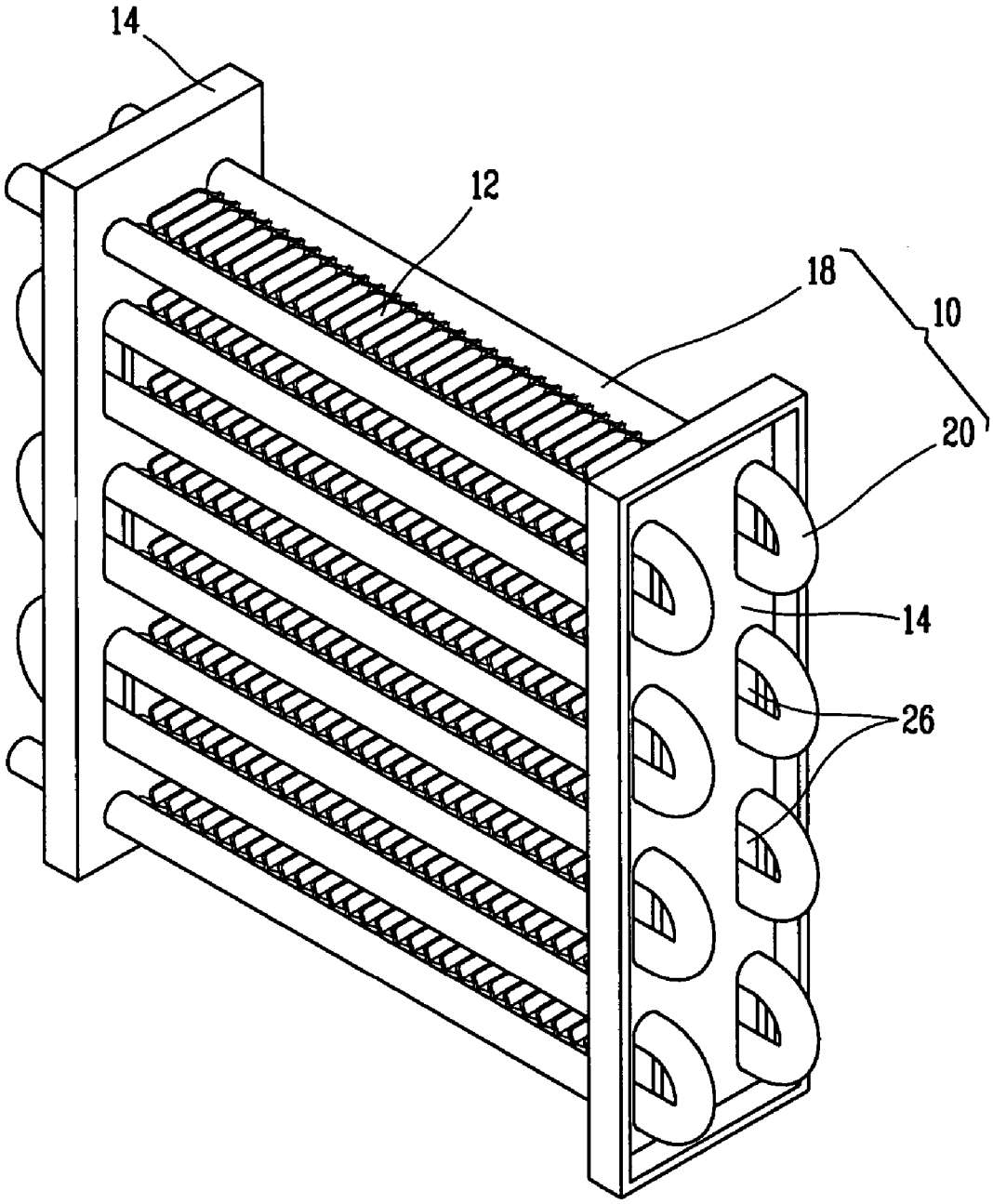
FIG. 5 is a perspective view of a heat exchanger according to the present invention.

FIG. 5 is a perspective view of a heat exchanger according to the present invention.

The heat exchanger according to the present invention comprises a refrigerant pipes 10 arranged with a certain interval for passing a refrigerant, a plurality of cooling fins 12 mounted at the refrigerant pipe 10 for expanding a contact area of air which passes through the refrigerant pipes 10 in order to enhance a heat transmitting performance, and a supporting holder 14 mounted at both sides of the refrigerant pipes 102 for supporting the heat exchanger.

A plurality of the refrigerant pipes 10 are arranged with a certain interval as a tube type by which a refrigerant can pass, and the cooling fins 12 are integrally formed between the refrigerant pipes 10. That is, two refrigerant pipes 10 are horizontally arranged and the cooling fins 12 are integrally formed therebetween.

Figure 6:
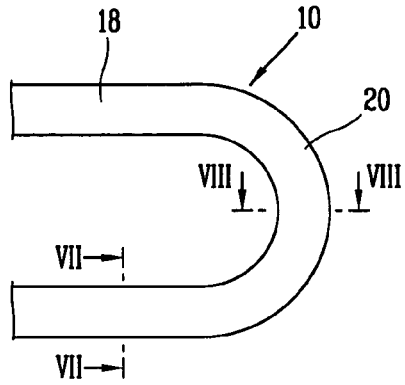
FIG. 6 is a partial lateral view of a refrigerant pipe of a heat exchanger according to the present invention.

As shown in FIG. 6, the refrigerant pipe 10 is composed of a straight-line portion 18 of a straight line shape in which the cooling fins are formed and a bending portion 20 in which the straight-line portion 18 are bent many times as a U shape with a certain interval and the refrigerant fins are removed in order to be fixed to the supporting holder 14. At an inner circumferential surface of the refrigerant pipe 10, a plurality of grooves 30 are formed in the length direction thus to prevent the bending portion 20 from being distorted when the refrigerant pipe 10 is bending-processed.

Figure 7:
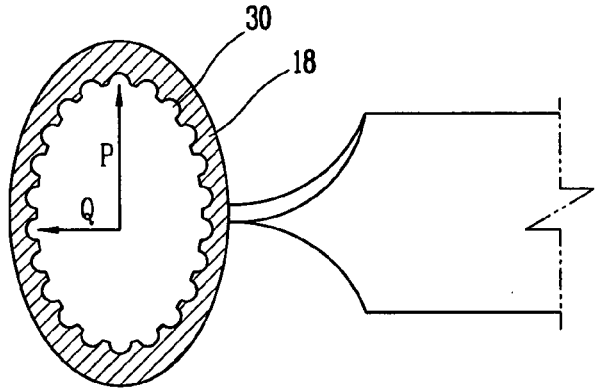
FIG. 7 is a sectional view taken along line VII—VII of FIG. 6.

As shown in FIG. 7, the straight-line portion 18 of the refrigerant pipe 10 is formed as an oval shape. That is, a major axis P of the straight-line portion 18 of the refrigerant pipe 10 is a diameter in a direction that the refrigerant pipe is stacked, and a minor axis Q thereof is a diameter in a perpendicular direction to the direction that the refrigerant pipe is stacked.

That is, the straight-ling portion 18 is formed as an oval shape, in which a direction that the refrigerant pipe 10 is bent becomes the major axis P and a perpendicular direction to the direction that the refrigerant pipe 10 is bent becomes the minor axis Q.

A length ratio between the major axis P and the minor axis Q of the straight-line portion 18 of the refrigerant pipe 10 is preferably 1.4~2.1:1.

Figure 8:
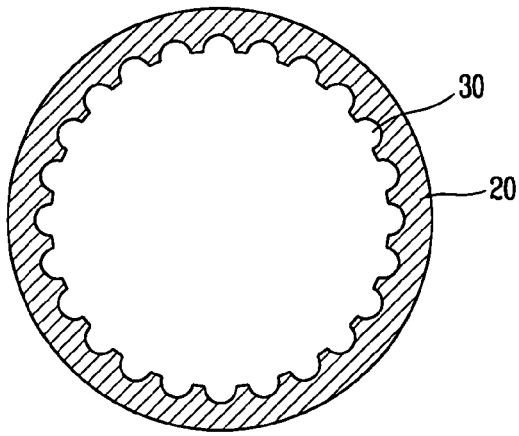
FIG. 8 is a sectional view taken along line VIII—VIII of FIG. 6.

As shown in FIG. 8, the bending portion 20 of the refrigerant pipe 10 is formed as a right circular shape. That is, since the straight-line portion 18 of the refrigerant pipe 10 is formed as an oval shape, if the straight-line portion 18 is bending-processed, the bending portion 20 has a circular shape. Accordingly, the bending portion 20 is prevented from being distorted and a flow resistance of a refrigerant is decreased.

The straight-line portion of the refrigerant pipe can be also formed as a rectangular shape besides the aforementioned oval shape.

The cooling fins 12A and 12B are arranged between the refrigerant pipes 10 with a certain interval in a perpendicular direction to an axial direction, and have a certain inclination angle in order to smoothly discharge condensation water and to smoothly contact with air.

The supporting holder 14 is provided with a plurality of slots 26 into which the bending portions 20 of the refrigerant pipes 10 are inserted.

A fabrication method of the heat exchanger according to the present invention will be explained in more detail as follows.

Two refrigerant pipes 10 and a cooling fin forming portion of a flat type having a certain thickness are extrusion-molded by using an extruder. At this time, the refrigerant pipe 10 is extrusion-molded in a condition that a cross section thereof has an oval shape. Then, the cooling fin forming portion is passed through a louvering gear which two gears are engaged, so that the cooling fin forming portion is punched with a certain interval by the louvering gear thus to form the plurality of cooling fins 12.

Then, the refrigerant pipe 10 where the cooling fins 12 are formed are bended many times with a certain interval thus to form the bending portion. At this time, since the straight-line portion 18 of the refrigerant pipe 10 is formed as an oval shape, the bending portion 20 of the refrigerant pipe 10 is formed as a circular shape.

Subsequently, the cooling fins 12 formed at the bending portion 20 are removed and the bending portion 20 is inserted into the slots 26 of the supporting holder 14, thereby completing an assembly.

Figure 9A:
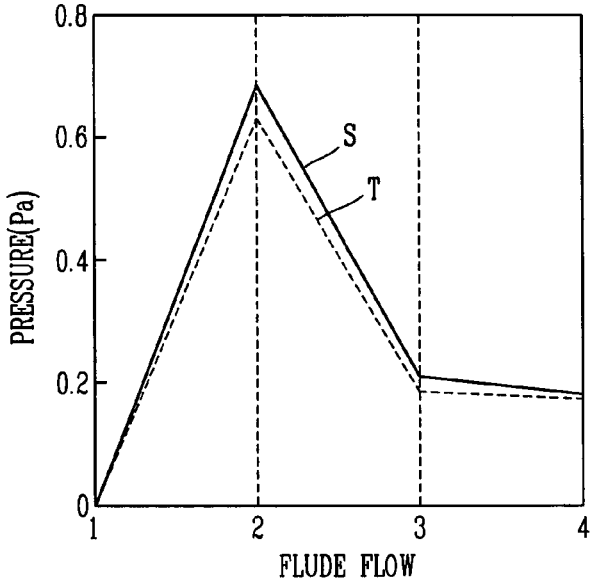
FIGS. 9A and 9B are graphs respectively showing a refrigerant flow of a heat exchanger according to the present invention and the conventional art.
Figure 9B:
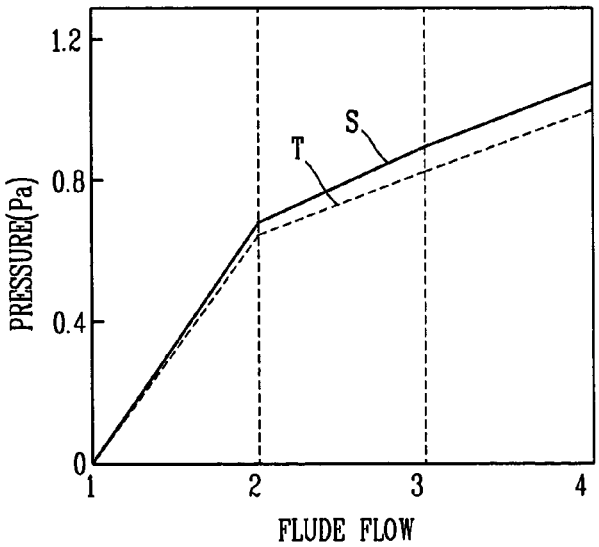

FIG. 9A and 9B are graphs showing a comparison of pressures according to a fluid flow between the heat exchanger according to the present invention and the heat exchanger according to the conventional art. The FIG. 9A shows a flow pressure generated when a fluid passes through the refrigerant pipe by each section, and the FIG. 9B shows an accumulated pressure of each section. From the graphs, it can be seen that the pressures T of each section of a refrigerant which passes through the refrigerant pipe of a right circular shape are greatly lower than the pressures S of a refrigerant which passes through the refrigerant pipe of an oval shape. Accordingly, in the heat exchanger to which the refrigerant pipe according to the present invention is applied, a refrigerant flow resistance can be greatly lowered than in the heat exchanger to which the conventional refrigerant pipe is applied, thereby enhancing a heat exchange performance.

Effects of the heat exchanger according to the present invention and the fabrication method thereof will be explained.

In the heat exchanger according to the present invention, the refrigerant pipe is formed as an oval shape in which a major axis is towards a direction that the refrigerant pipe is bent. According to this, when the refrigerant pipe is bending-processed, the bending portion is formed as a circular shape thus to greatly reduce a flow resistance of a refrigerant and thereby to enhance a heat exchange performance.

Also, in a fabrication process of the heat exchanger, a phenomenon that the bending portion is distorted can be prevented even when a working speed is fast, thereby accelerating a working speed and enhancing a productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A heat exchanger comprising:

a plurality of refrigerant pipes bent several times for passing a refrigerant for heat exchange, wherein each of the plurality of refrigerant pipes comprises a plurality of straight-line portions arranged in a plurality of rows and each of the plurality of rows has at least two horizontally arranged straight-line portions and bending portions; and cooling fins integrally arranged between the at least two horizontally arranged straight-line portions for expanding a contact area for air to pass through the plurality of refrigerant pipes, wherein the straight-line portions each have an oval cross-section; and the bending portions are formed by bending a section of the straight-line portions having a circular cross-section.

2. The heat exchanger of claim 1, wherein a major axis of the straight-line portion of the plurality of refrigerant pipes has a diameter along a direction that the plurality of refrigerant pipes is stacked, and a minor axis has a diameter perpendicular to the direction that the plurality of refrigerant pipes is stacked.

3. The heat exchanger of claim 2, wherein a length ratio between the major axis and the minor axis of each of the plurality of refrigerant pipes is selected within the range of approximately 1.4 to 2.1: 1.

4. The heat exchanger of claim 1, wherein a plurality of grooves are formed at an inner circumferential surface of each of the plurality of refrigerant pipes along an axial direction.

5. A refrigerant flow apparatus for decreased resistance to heat exchange, the refrigerant flow apparatus comprising:

a plurality of refrigerant pipes having a straight-line portion and a bending portion formed during a bending-process of the plurality of refrigerant pipes for passing a refrigerant for heat exchange, wherein each of the plurality of refrigerant pipes comprises a plurality of straight-line portions arranged in a plurality of rows and each of the plurality of rows has at least two horizontally arranged straight-line portions and bending portions;

a plurality of grooves formed on an inner circumferential surface of the plurality of refrigerant pipes along an axial direction; and cooling fins integrally provided on an outer circumference of the straight-line portion between the at least two horizontally arranged straight-line portions to increase a contact area for which air passes through the plurality of refrigerant pipes, wherein the bending portion has a circular-shaped cross-section area for lowering a pressure of the refrigerant passing through the bending portion, and wherein the straight-line portion has an oval-shaped cross-section area.

6. A method for manufacturing refrigerant pipes having decreased resistance to refrigerant flow, the method comprising:

providing the refrigerant pipes having at least one portion having an oval-shaped cross-section area and at least one portion having a circular-shaped cross-section area, wherein the cross-section areas are perpendicular to an axis of the refrigerant pipes, the axis being along a direction of refrigerant flow;

arranging each of the refrigerant pipes in a plurality of rows for each of the plurality of rows to have at least two horizontally arranged straight-line portions and bending portions;

forming a plurality of grooves on an interior surface of the refrigerant pipes perpendicular to the axis of the refrigerant pipes; and bending the circular-shaped cross-section area of the refrigerant pipes along the axis of the refrigerant pipes to form the bending portion.

7. The method of claim 6, further comprising:

positioning cooling fins between the at least two horizontally arranged straight-line portions of the refrigerant pipes, wherein the cooling fins have a certain inclination angle for smoothly discharging condensation water and providing a contact surface with air.

8. The method of claim 7, further comprising:

removing the cooling fins along the at least one portion of the refrigerant pipes having the circular-shaped cross-section area.

* * * * *